US009786428B2

(12) United States Patent
Yang et al.

(10) Patent No.: US 9,786,428 B2
(45) Date of Patent: Oct. 10, 2017

(54) COMMON MODE FILTER AND METHOD OF MANUFACTURING THE SAME

(71) Applicant: Samsung Electro-Mechanics Co., Ltd., Suwon-si, Gyeonggi-do (KR)

(72) Inventors: Jin Hyuck Yang, Suwon-si (KR); Young Seuck Yoo, Suwon-si (JP); Sung Kwon Wi, Suwon-si (KR); Hye Won Bang, Suwon-si (KR); Geon Se Chang, Suwon-si (KR); Young Do Kweon, Suwon-si (KR); Ju Hwan Yang, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 591 days.

(21) Appl. No.: 14/192,471

(22) Filed: Feb. 27, 2014

(65) Prior Publication Data

US 2014/0240075 A1 Aug. 28, 2014

(30) Foreign Application Priority Data

Feb. 28, 2013 (KR) ..... 10-2013-0021811

(51) Int. Cl.

| | |
|---|---|
| ***H01F 5/00*** | (2006.01) |
| ***H01F 27/28*** | (2006.01) |
| ***H01F 27/29*** | (2006.01) |
| ***H01F 17/00*** | (2006.01) |

(52) U.S. Cl.
CPC ..... *H01F 27/292* (2013.01); *H01F 17/0013* (2013.01); *H01F 2017/0066* (2013.01)

(58) Field of Classification Search
CPC ..... H01F 2017/0066
USPC ..... 336/200, 223, 232
See application file for complete search history.

(56) References Cited

U.S. PATENT DOCUMENTS

2010/0157565 A1* 6/2010 Yoshida et al. ..... 361/811

FOREIGN PATENT DOCUMENTS

| | | |
|---|---|---|
| JP | 2012-015494 A | 1/2012 |
| KR | 1020060126887 | 12/2006 |
| KR | 10-2011-0012277 | 2/2011 |

* cited by examiner

*Primary Examiner* — Ronald Hinson
(74) *Attorney, Agent, or Firm* — McDermott Will & Emery LLP

(57) ABSTRACT

Disclosed herein is a common mode filter, including: a magnetic substrate; and a body part formed on the magnetic substrate, wherein the body part is configured of an insulating layer surrounding a coil electrode, an outer electrode terminal connected with an end of the coil electrode, and a magnetic resin composite, the insulating layer is formed on the magnetic substrate, having a margin part M disposed at an edge of the magnetic substrate, and the magnetic resin composite is filled in an empty space of the body part including the margin part M, thereby promoting a consecutive flow of magnetic flux that is generated from the coil electrode.

4 Claims, 7 Drawing Sheets

【FIG. 1】
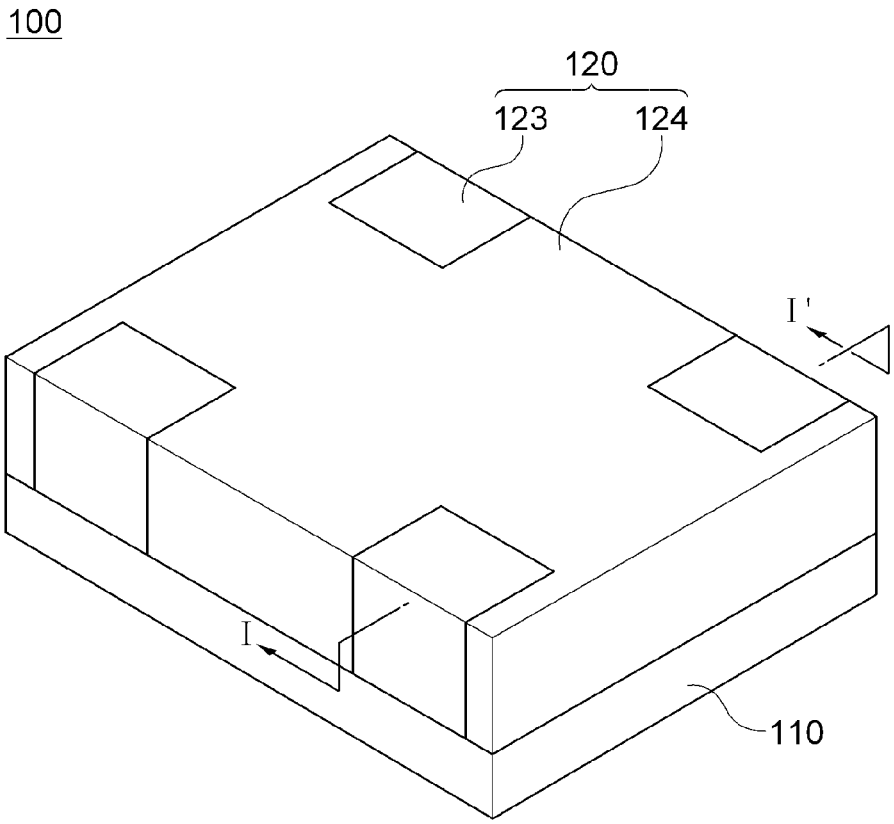
【FIG. 2】
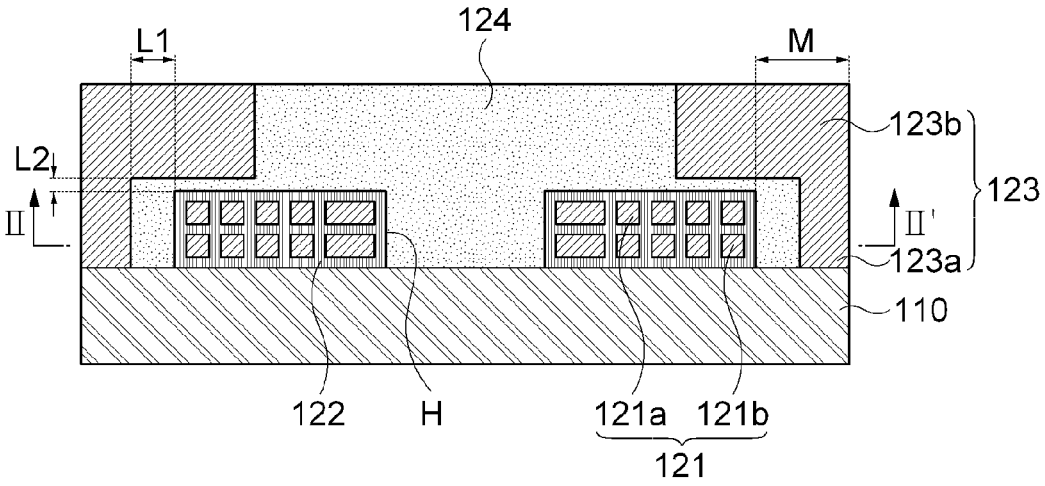

【FIG. 3】
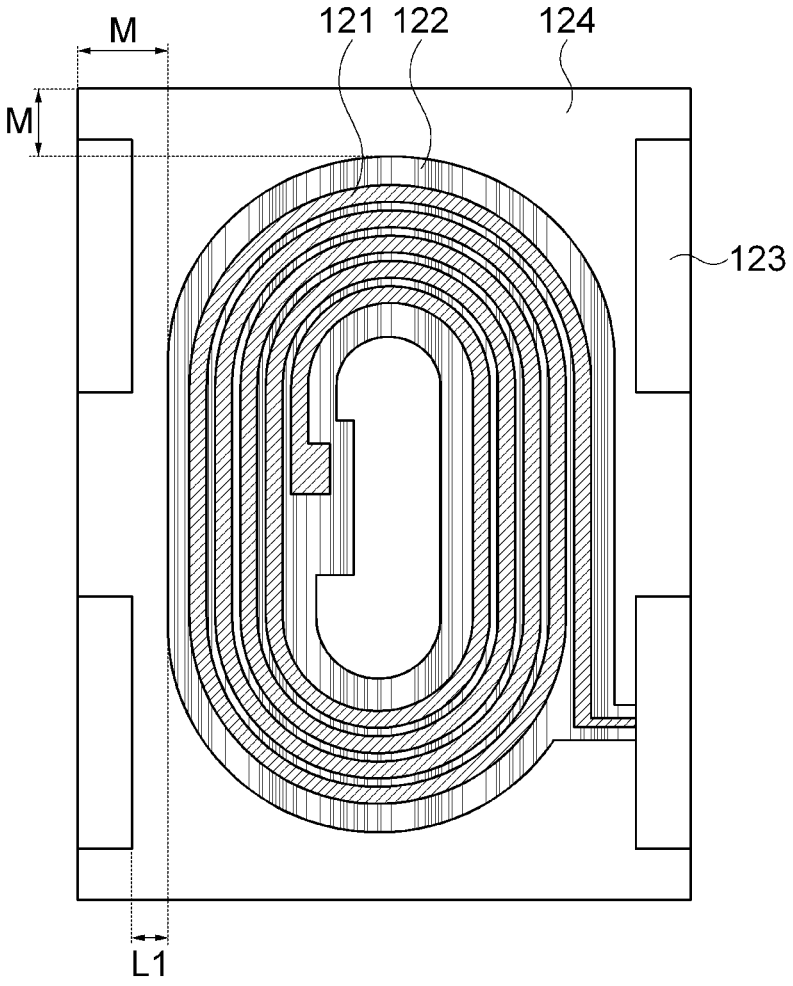

【FIG. 4】
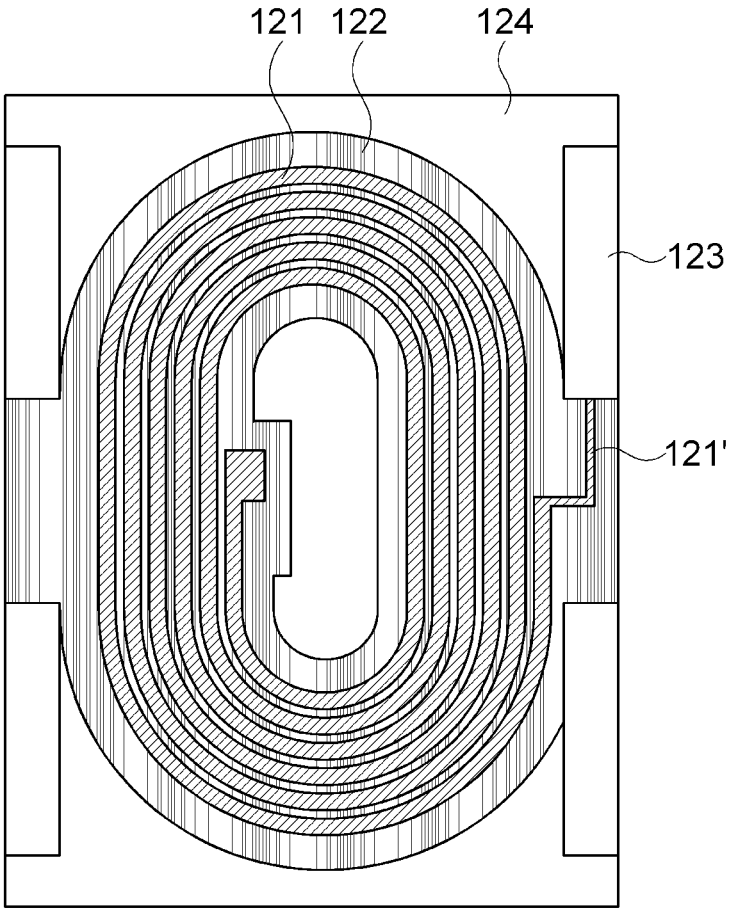

【FIG. 5】
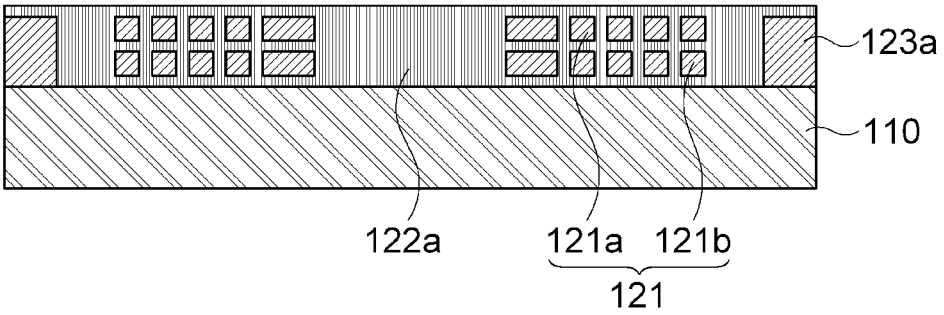
【FIG. 6】
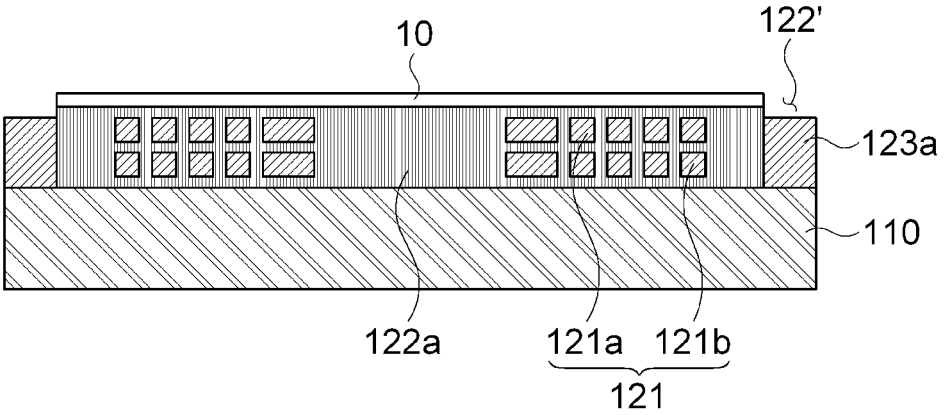
【FIG. 7】
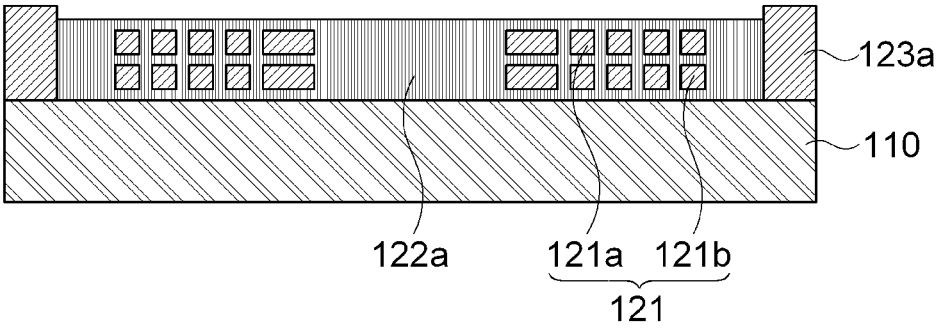

【FIG. 8】
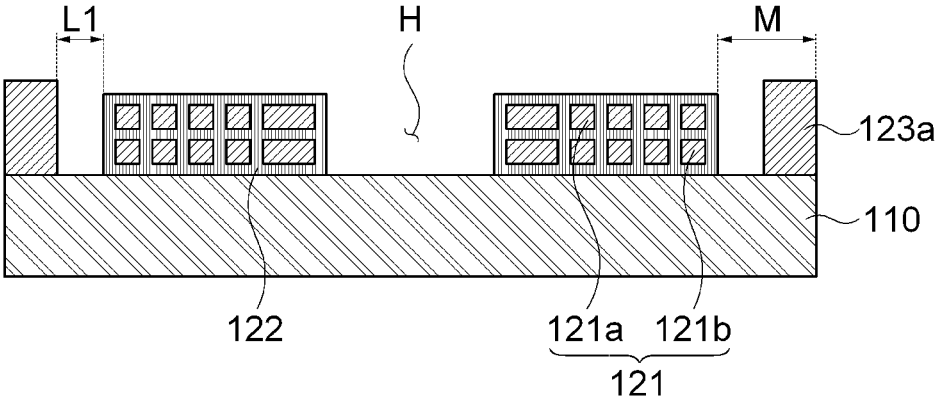
【FIG. 9】
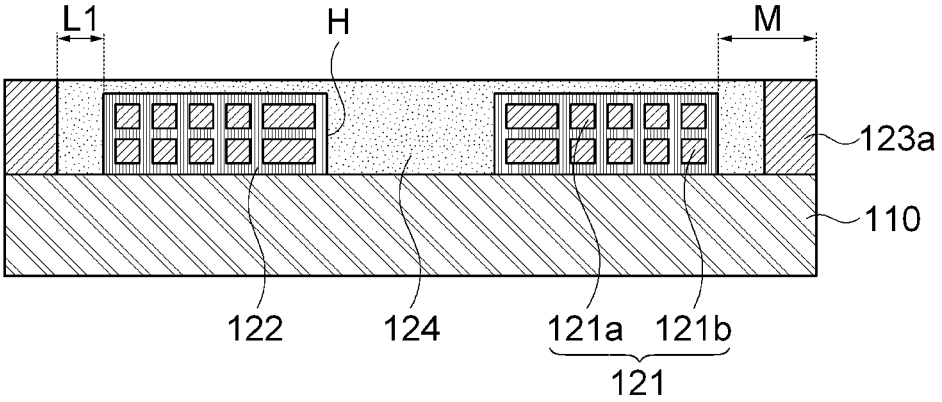
【FIG. 10】
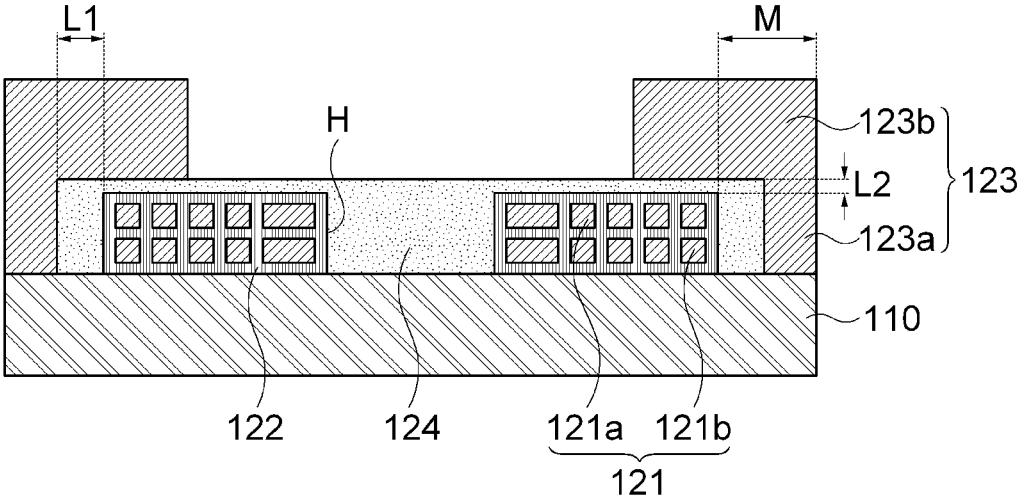

【FIG. 11】
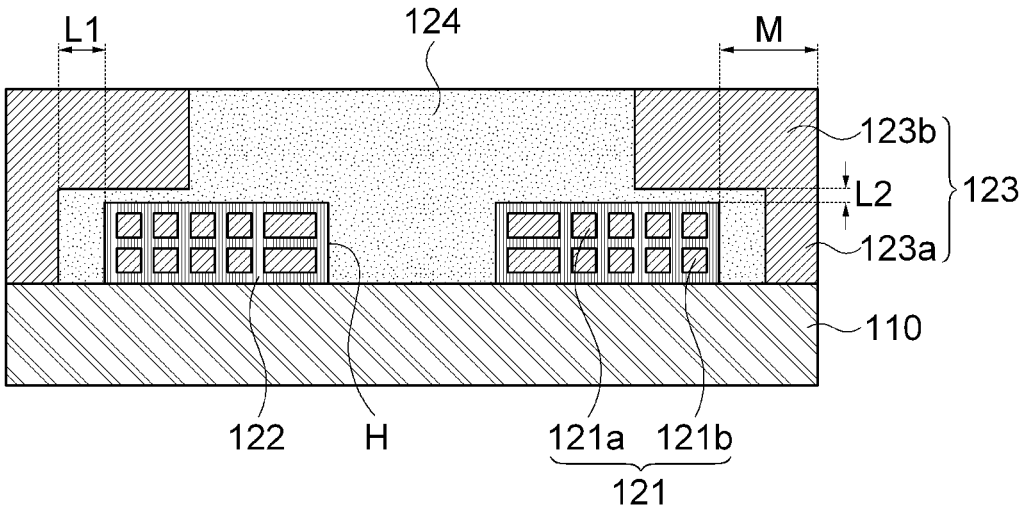
【FIG. 12】
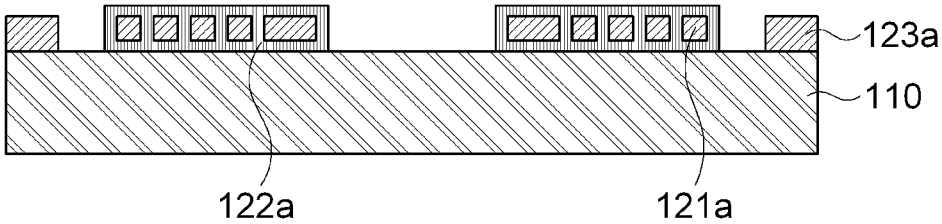
【FIG. 13】
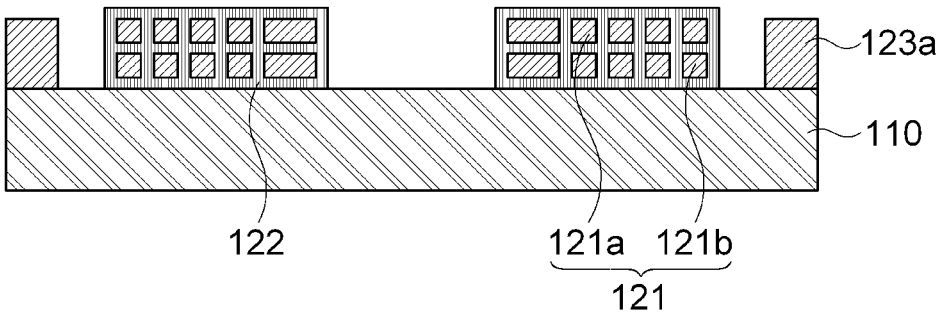

【FIG. 14】
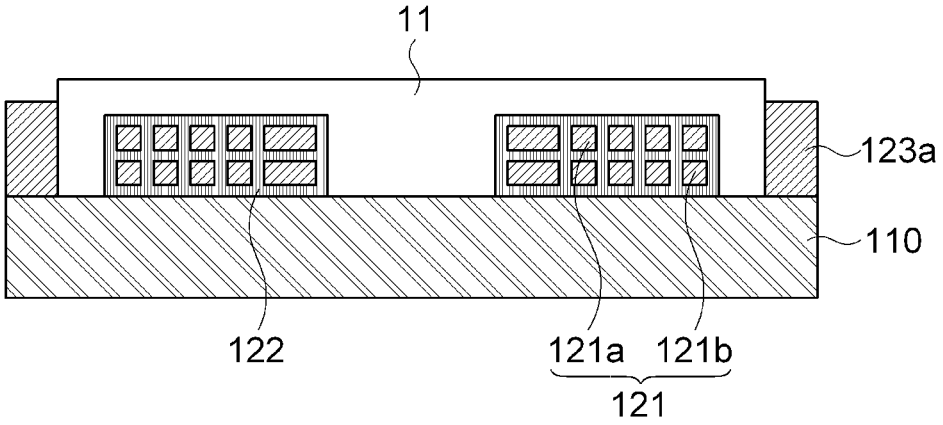

COMMON MODE FILTER AND METHOD OF MANUFACTURING THE SAME

CROSS REFERENCE(S) TO RELATED APPLICATIONS

This application claims the benefit under 35 U.S.C. Section 119 of Korean Patent Application Serial No. 10-2013-0021811 entitled "Common Mode Filter And Method Of Manufacturing The Same" filed on Feb. 28, 2013, which is hereby incorporated by reference in its entirety into this application.

BACKGROUND OF THE INVENTION

1. Technical Field

The present invention relates to a common mode filter and a method of manufacturing the same, and more particularly, to a common mode filter connected with a space in which a magnetic flux is formed and a method of manufacturing the same.

2. Description of the Related Art

In accordance with the development of a technology, electronic devices such as a portable phone, a home appliance, a personal computer (PC), a personal digital assistant (PDA), a liquid crystal display (LCD), and the like, have been changed from an analog scheme into a digital scheme and have been speeded up due to an increase in a data amount to be processed. Therefore, USB 2.0, USB 3.0, and a high-definition multimedia interface (HDMI) have been widely distributed as a high speed signal transmission interface and used in numerous digital devices, such as a personal computer, a high quality digital television, and the like.

Unlike a single-end transmission system generally used for a long period of time, these interfaces adopt a differential signal system that uses a pair of signal lines to transmit a differential signal (differential mode signal). However, the digitized and speeded up electronic devices are sensitive to stimulus from the outside. That is, in the case in which small abnormal voltage and a high frequency noise are introduced from the outside into an internal circuit of the electronic device, a circuit may be damaged and a signal may be distorted.

In order to prevent a circuit breakage or a signal distortion of electronic devices from occurring, a filter is mounted to interrupt the introduction of abnormal voltage and high frequency noise into a circuit. Generally, a common mode filter has been used in a high speed differential signal line, and the like, to remove a common mode noise.

The common mode noise is noise occurring at the differential signal line and the common mode filter removes noises that may not be removed by the existing EMI filter. The common mode filter contributes to improvement in EMC characteristics of a home appliance, and the like, and improvement of antenna characteristics of a cellular phone, and the like.

Referring to Japanese Patent Laid-Open Publication No. 2012-015494, a general common mode filter according to the related art has a structure in which a magnetic substrate is disposed at a lower part thereof, an insulating layer enclosing a coil electrode is stacked thereon, and a magnetic resin composite is disposed on the insulation layer.

The magnetic substrate and the magnetic resin composite may be made a ferrite composition having high permeability, such that the magnetic flux in the vicinity of the coil electrode that is generated from the coil electrode in the foregoing structure continuously flows along the magnetic substrate and the magnetic resin composite.

However, in the structure according to the related art, an insulating layer having low permeability exists in the magnetic substrate and the magnetic resin composite, such that the flow of magnetic flux may be weakened, thereby degrading impedance and cut-off frequency characteristics of the common mode filter.

Further, the magnetic substrate and the magnetic resin composite is made of Ni—Zn-based, Mn—Zn-based, Ni—Zn-based, Ni—Zn—Mg-based, Mn—Mg—Zn-based ferrite or a mixture thereof, whereas the insulating layer may be made of polymer materials, such as epoxy resin, phenol resin, polyimide resin, and the like. As such, cracks or a delamination phenomenon may occur at a boundary surface between the magnetic substrate and the insulating layer and the magnetic resin composite and the insulating layer due to a bonding of heterogeneous materials having different chemical characteristics.

RELATED ART DOCUMENT

Patent Document (Patent Document 1) Patent Document: Japanese Patent Laid-Open Publication No. 2012-015494

SUMMARY OF THE INVENTION

An object of the present invention is to provide a common mode filter capable of reinforcing an inter-layer bonding strength of the common mode filter and smoothly moving a magnetic flux in the vicinity of a coil electrode and a method of manufacturing the same.

According to an exemplary embodiment of the present invention, there is provided a common mode filter including: a magnetic substrate; and a body part formed on the magnetic substrate, wherein the body part is configured of an insulating layer surrounding a coil electrode, an outer electrode terminal connected with an end of the coil electrode, and a magnetic resin composite, the insulating layer is formed on the magnetic substrate, having a margin part M disposed at an edge of the magnetic substrate, and the magnetic resin composite is filled in an empty space of the body part including the margin part M.

The outer electrode terminal may be disposed to be spaced apart from the insulating layer by a predetermined interval and the magnetic resin composite may be filled in the empty space of the body part including a space between the outer electrode terminal and the insulating layer.

The outer electrode terminal may be configured of a side wall part spaced apart from a side of the insulating layer by a predetermined interval L1 and an upper end spaced apart from an upper surface of the insulating layer by a predetermined interval L2 and the magnetic resin composite may be filled in an empty space of the body part including a space between the side wall part of the outer electrode terminal and the insulating layer and a space between the upper end of the outer electrode terminal and the insulating layer.

A central portion of the insulating layer may be formed with a hollow part H and the magnetic resin composite may be filled in the empty space of the body part including the hollow part H.

According to another exemplary embodiment of the present invention, there is provided a method of manufacturing a common mode filter, including: (a) forming an insulating layer having a coil electrode embedded therein and having a hollow part H disposed at a central portion thereof and a side wall part of an outer electrode terminal on a magnetic substrate, having a margin part M disposed at an edge of the magnetic substrate; (b) forming a magnetic resin composite by filling and curing a magnetic resin ferrite on the magnetic substrate including the margin part M and the hollow part H; (c) plating an upper end of the outer electrode terminal on the magnetic resin composite; and (d) forming the magnetic resin composite by filling and curing the magnetic resin ferrite up to a height of the upper end of the outer electrode terminal.

The height of the side wall part of the outer electrode terminal plated in the (a) may be higher than that of the insulating layer and the magnetic resin ferrite filled in the (b) may be filled up to the height of the side wall part of the outer electrode terminal.

The side wall part of the outer electrode terminal may be disposed at a position spaced apart from the insulating layer by a predetermined interval.

In the (a), an insulating resin covering the coil electrode and the side wall part of the outer electrode terminal may be formed by repeatedly performing a process of applying and plating the insulating resin and a filling region of the magnetic resin ferrite may be etched in the insulating resin.

Prior to etching the filling region of the magnetic resin ferrite, an opening part exposing the side wall part of the outer electrode terminal may be processed and after attaching a resist on the insulating resin, the plating process may be performed to plate and grow the side wall part of the outer electrode terminal.

BRIEF DESCRIPTION OF THE DRAWINGS

FIG. 1 is a perspective view of a common mode filter according to an exemplary embodiment of the present invention.

FIG. 2 is a cross-sectional view taken along the line I-I' of FIG. 1.

FIG. 3 is a cross-sectional view taken along the line II-II' of FIG. 2.

FIG. 4 is a diagram illustrating a modification example of the present invention.

FIGS. 5 to 11 are views sequentially illustrating processes of a method of manufacturing a common mode filter according to the exemplary embodiment of the present invention.

FIGS. 12 to 14 are views sequentially illustrating processes of a method of manufacturing a common mode filter according to another exemplary embodiment of the present invention.

DESCRIPTION OF THE PREFERRED EMBODIMENTS

Various advantages and features of the present invention and methods accomplishing thereof will become apparent from the following description of exemplary embodiments with reference to the accompanying drawings. However, the present invention may be modified in many different forms and it should not be limited to exemplary embodiments set forth herein. These exemplary embodiments may be provided so that this disclosure will be thorough and complete, and will fully convey the scope of the invention to those skilled in the art.

Terms used in the present specification are for explaining exemplary embodiments rather than limiting the present invention. Unless explicitly described to the contrary, a singular form includes a plural form in the present specification. The word "comprise" and variations such as "comprises" or "comprising," will be understood to imply the inclusion of stated constituents, steps, operations and/or elements but not the exclusion of any other constituents, steps, operations and/or elements.

FIG. 1 is a perspective view of a common mode filter according to an exemplary embodiment of the present invention, FIG. 2 is a cross-sectional view taken along the line I-I' of FIG. 1; and FIG. 3 is a cross-sectional view taken along the line II-II' of FIG. 2. Additionally, components shown in the accompanying drawings are not necessarily shown to scale. For example, sizes of some components shown in the accompanying drawings may be exaggerated as compared with other components in order to assist in the understanding of the exemplary embodiments of the present invention. Meanwhile, throughout the accompanying drawings, the same reference numerals will be used to describe the same components. For simplification and clearness of illustration, a general configuration scheme will be shown in the accompanying drawings, and a detailed description of the feature and the technology well known in the art will be omitted in order to prevent a discussion of exemplary embodiments of the present invention from being unnecessarily obscure.

Referring to FIGS. 1 to 3, a common mode filter 100 according to the exemplary embodiment of present invention may be configured to include a magnetic substrate 110 and a body part 120 disposed on the magnetic substrate 110. In addition, the body part 120 may include a coil electrode 121, an insulating layer 122, outer electrode terminals 123, and a magnetic resin composite 124.

The insulating layer 122 surrounding the coil electrode 121 serves to protect the coil electrode 121 from external environment while imparting insulating property to the coil electrode 121. Therefore, construction materials of the insulating layer 122 may be appropriately selected in consideration of insulating property, heat resistance, moisture resistance, and the like. For example, an example of optimal polymer materials forming the insulating layer 122 may include thermosetting resin, such as epoxy resin, phenol resin, urethane resin, silicon resin, polyimide resin, and the like, and thermoplastic resin, such as polycarbonate resin, acrylic resin, polyacetal resin, polypropylene resin, and the like.

The coil electrode 121 is an electrode plated on a plane in a coil form and may be configured of a primary coil electrode 121*a* and a secondary coil electrode 121*b* that are electromechanically coupled. As illustrated in FIG. 2, the primary coil electrode 121*a* and the secondary coil electrode 121*b* are plated to be vertically spaced apart from each other by a predetermined interval. Unlike this, alternatively, each pattern of the primary and secondary coil electrodes 121*a* and 121*b* are alternately arranged, and thus may be plated simultaneously on the same layer.

A central portion of the insulating layer 122 is provided with a hollow part H which may be filled with the magnetic resin composite 124. Therefore, the coil electrode 121 is wound around the magnetic resin composite 124 filled in the hollow part H in a predetermined turn number.

In the present invention, the insulating layer 122 is disposed on the magnetic substrate 110, having a margin part M disposed at an edge of the magnetic substrate 110. Therefore, the magnetic resin composite 124 may be filled in an empty space of the body part 120 including the margin part M. That is, the magnetic resin composite 124 is directly bonded to the magnetic substrate 110, having the insulating layer 122 buried thereinto.

The insulating layer 122 surrounds the coil electrode 121 to correspond to a section shape of the coil electrode 121, such that when the section shape of the coil electrode 121 is an oval shape as illustrated in FIG. 3, the section shape of the insulating layer 122 may also be an oval shape.

The outer electrode terminals 123 connected with each end of the coil electrode 121 may be disposed to be spaced apart from the insulating layer 122 by a predetermined interval, such that the magnetic resin composite 124 may be filled in the empty space of the body part 120 including a space between the outer electrode terminal 123 and the insulating layer 122.

Meanwhile, as illustrated in FIG. 4, when a diameter of the hollow part H is large, the outer electrode terminal 123 may contact a part of the insulating layer 122. Alternatively, a part of the insulating layer 122 may also be formed to invade the margin part according to a position of a lead wire 121' that connects the coil electrode 121 with the outer electrode terminal 123.

Referring back to FIGS. 1 to 3, describing in detail a structure of the outer electrode terminal 123, the outer electrode terminal 123 may be configured of a side wall part 123*a* spaced apart from a side of the insulating layer 122 by a predetermined interval L1 and an upper end 123*b* spaced apart from an upper surface of the insulating layer 122 by a predetermined interval L2.

Further, the magnetic resin composite 124 may be filled in a space between the side wall part 123*a* of the outer electrode terminal 123 and the insulating layer 122 and between the upper end 123*b* of the outer electrode terminal 123 and the insulating layer 122, in response to a shape of the outer electrode terminal 123. In addition, the magnetic resin composite 124 having the same thickness as the upper ends 123*b* of the outer electrode terminal 123 may be filled between the upper ends 123*b* of the outer electrode terminal 123.

That is, in the present invention, the magnetic resin composite 124 is formed within the body part 120 in a seamless form in which a predetermined section thereof is not broken. Therefore, the magnetic flux generated from the coil electrode 121 flows seamlessly, such that the common mode filter 100 having the structure of the present invention may have the more improved impedance and cut-off frequency characteristics than those of the common mode filter according to the related art.

In addition, the magnetic substrate 110 made of the homogeneous material with the magnetic resin composite 124, for example, Ni—Zn-based, Mn—Zn-based, Ni—Zn-based, Ni—Zn—Mg-based, Mn—Mg—Zn-based ferrite, and the like is directly bonded to the magnetic resin composite 124, thereby increasing the bonding strength therebetween.

Hereinafter, a method of manufacturing a common mode filter 100 according to the exemplary embodiment of the present invention will be described.

FIGS. 5 to 11 are views sequentially illustrating processes of a method of manufacturing a common mode filter according to the exemplary embodiment of the present invention. The method of manufacturing a common mode filter according to the exemplary embodiment of the present invention includes forming the insulating layer 122 having the coil electrode 121 embedded therein and having the hollow part H disposed at the central portion thereof and the side wall part 123*a* of the outer electrode terminal 123 on the magnetic substrate 110. In this case, the insulating layer 122 is formed, having the margin part M disposed at the edge of the magnetic substrate 110.

Describing in more detail the process, first, the primary and secondary coil electrodes 121*a* and 121*b*, the side wall part 123*a* of the outer electrode terminal 123, and an insulating resin 122*a* covering them are formed as illustrated in FIG. 5 by repeatedly performing a process of applying and plating an insulating resin on the prepared magnetic substrate 110.

The primary and secondary coil electrodes 121*a* and 121*b* and the side wall part 123*a* of the outer electrode terminal 123 may be formed using general known plating methods, such as a subtract method, an additive method, a semi additive method, and the like. Therefore, although not illustrated in the drawings, a seed layer for pre-processing of electroplating may also exist according to the plating method.

Next, in order to make a height of the side wall part 123*a* of the outer electrode terminal 123 higher than the insulating resin 122*a*, as illustrated in FIG. 6, an opening part 122' exposing the side wall part 123*a* of the outer electrode terminal 123 is processed, and then a resist 10 is attached on the insulating resin 122*a* and the plating process is performed. When the plating process ends and then the resist 10 is removed, as illustrated in FIG. 7, the side wall part 123*a* of the outer electrode terminal 123 higher than the insulating resin 122*a* is completed.

Next, as illustrated in FIG. 8, a process of selectively etching the insulating resin 122*a* is performed. This may use a photolithography process, and the like, such that the filling region of the magnetic resin composite 124 including the margin part M and the hollow part H is opened.

Meanwhile, the process until now may be performed by a method of opening a filling region of the magnetic resin composite 124 based on a one-time etching process after applying the insulating resin covering the primary and secondary coil electrodes 121*a* and 121*b*, but unlike this, as illustrated in FIGS. 12 and 13, the etching process may be performed on each layer. In this case, as illustrated in FIG. 14, a finally opened region is covered with a mask 11 and the plating process is performed, such that the thickness of the side wall part 123*a* of the outer electrode terminal 123 may be increased.

As such, when the predetermined region is opened, as illustrated in FIG. 9, a process of forming the magnetic resin composite 124 is performed by filling and curing the magnetic resin ferrite on the magnetic substrate 110 including the margin part M and the hollow part H.

The magnetic resin composite 124 may be formed by filling and curing the magnetic resin paste, which is prepared by mixing at least one powder of Ni—Zn-based, Mn—Zn-based, Ni—Zn—Mg-based, and Mn—Mg—Zn-based ferrites and a resin as main component, up to the height of the side wall part 123*a* of the outer electrode terminal 123.

Next, as illustrated in FIG. 10, the upper end 123*b* of the outer electrode terminal 123 having a wider area than that of the side wall part 123*a* of the outer electrode terminal 123 is plated at a predetermined thickness. As described above, since the height of the side wall part 123*a* of the outer electrode terminal 123 is formed to be higher than that of the insulating layer 122, the magnetic resin composite 124 filled during the previous process is disposed in the predetermined interval L2 between the upper end 123*b* of the outer electrode terminal 123 and the insulating layer 122.

Finally, as illustrated in FIG. 11, the common mode filter 100 having the magnetic resin composite 124 formed between the outer electrode terminals 123 is finally completed by filling and curing the magnetic resin ferrite up to the height of the upper end 123*b* of the outer electrode terminal 123.

According to the exemplary embodiments of the present invention, the common mode filter has a structure in which the magnetic resin composite exists in the vicinity of the insulating layer surrounding the coil electrode and the magnetic resin composite is directly bonded to the magnetic substrate, thereby greatly improving the impedance and cut-off frequency characteristics of the common mode filter without the section in which the magnetic flux is weakened due to the insulating layer, as in the related art.

In addition, the common mode filter has the structure in which the magnetic resin composite including the same material as the construction material of the magnetic substrate is directly bonded to the magnetic substrate, having the insulating layer buried thereinto, thereby reinforcing the inter-layer bonding strength of the common mode filter.

The present invention has been described in connection with what is presently considered to be practical exemplary embodiments. Although the exemplary embodiments of the present invention have been described, the present invention may be also used in various other combinations, modifications and environments. In other words, the present invention may be changed or modified within the range of concept of the invention disclosed in the specification, the range equivalent to the disclosure and/or the range of the technology or knowledge in the field to which the present invention pertains. The exemplary embodiments described above have been provided to explain the best state in carrying out the present invention. Therefore, they may be carried out in other states known to the field to which the present invention pertains in using other inventions such as the present invention and also be modified in various forms required in specific application fields and usages of the invention. Therefore, it is to be understood that the invention is not limited to the disclosed embodiments. It is to be understood that other embodiments are also included within the spirit and scope of the appended claims.

What is claimed is:

1. A common mode filter comprising:

a magnetic substrate; and a body part formed on the magnetic substrate, wherein the body part is configured of an insulating layer surrounding a coil electrode, an outer electrode terminal connected with an end of the coil electrode, and a magnetic resin composite, the insulating layer is formed on the magnetic substrate, having a margin part M disposed at an edge of the magnetic substrate, the outer electrode terminal is disposed to be spaced apart from the insulating layer by a predetermined interval, and the magnetic resin composite is filled in an empty space of the body part including the margin part M and a space between the outer electrode terminal and the insulating layer, to be in contact with a side surface and a top surface of the insulating layer.

2. The common mode filter according to claim 1, wherein the outer electrode terminal is configured of a side wall part spaced apart from a side of the insulating layer by a predetermined interval L1 and an upper end spaced apart from an upper surface of the insulating layer by a predetermined interval L2 and the magnetic resin composite is filled in an empty space of the body part including a space between the side wall part of the outer electrode terminal and the insulating layer and a space between the upper end of the outer electrode terminal and the insulating layer.

3. The common mode filter according to claim 1, wherein a central portion of the insulating layer is formed with a hollow part H and the magnetic resin composite is filled in the empty space of the body part including the hollow part H.

4. The common mode filter according to claim 1, wherein at least a portion of the magnetic resin composite is disposed directly on the magnetic substrate.

* * * * *